US012351990B2

(12) United States Patent
Bryant et al.

(10) Patent No.: US 12,351,990 B2
(45) **Date of Patent: *Jul. 8, 2025**

(54) PATH OF TRAVEL SLOPE BASED CONTROL OF ASPHALT COMPACTORS

(71) Applicant: Caterpillar Paving Products Inc., Brooklyn Park, MN (US)

(72) Inventors: Cary M Bryant, Plymouth, MN (US); John L. Marsolek, Watertown, MN (US); Nicholas A. Oetken, Brooklyn Park, MN (US); Matthew D. Chisholm, Maple Grove, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 313 days.

This patent is subject to a terminal disclaimer.

(21) Appl. No.: 18/117,048

(22) Filed: Mar. 3, 2023

(65) Prior Publication Data

US 2024/0295085 A1 Sep. 5, 2024

(51) Int. Cl.
*E01C 19/28* (2006.01)

(52) U.S. Cl.
CPC ..... *E01C 19/282* (2013.01)

(58) Field of Classification Search
None
See application file for complete search history.

(56) References Cited

U.S. PATENT DOCUMENTS

| | | | | |
|---|---|---|---|---|
| 6,741,949 | B2 | 5/2004 | Corcoran et al. | |
| 6,845,311 | B1 | 1/2005 | Stratton et al. | |
| 8,585,317 | B1 | 11/2013 | Sina | |
| 9,267,245 | B1 | 2/2016 | Braun | |
| 10,821,992 | B2 * | 11/2020 | Skillsäter | B60W 40/112 |
| 11,207,995 | B2 | 12/2021 | Marsolek | |
| 2004/0110601 | A1 * | 6/2004 | Kojima | B60W 10/02 477/174 |
| 2007/0239336 | A1 * | 10/2007 | Congdon | E02D 3/02 701/50 |
| 2017/0210375 | A1 * | 7/2017 | Orlamünder | B60L 50/66 |

FOREIGN PATENT DOCUMENTS

| | | | | |
|---|---|---|---|---|
| CN | 103074844 | | 5/2013 | |
| CN | 110258263 | | 9/2019 | |
| JP | H08104156 A | * | 9/1995 | B60K 31/047 |

* cited by examiner

*Primary Examiner* — Hitesh Patel
*Assistant Examiner* — Tabitha Kress

(57) ABSTRACT

The asphalt compactor may include a control system communicatively coupled to the one or more sensors including a grade sensor configured to determine a slope of the asphalt surface within the compacting area in at least the direction of travel of the asphalt compactor, the control system configured to: receive data indicative of the slope of the asphalt surface in at least the direction of travel of the asphalt compactor from the grade sensor, determine if the slope of the asphalt surface is one of an incline slope or a decline slope in the direction of travel, if the slope is determined to be the incline slope, determine if the incline slope exceeds a first threshold for the incline slope, and if the incline slope exceeds the first threshold for the incline slope, control a vibratory system to stop vibration of the trailing drum.

19 Claims, 3 Drawing Sheets

300

| | INCLINE | DECLINE | MAX SPEED |
|---|---|---|---|
| 1% | | | N/A |
| 2% | | | |
| 3% | | | |
| 4% | | STATIC BOTH DRUMS W / CONTROLLED SPEED & DECELERATION | 4MPH |
| 5% | STATIC TRAILING DRUM | | |
| 6% | | | |
| 7% | | | 3MPH |
| 8% | LOW AMP LEADING DRUM. STATIC TRAILING DRUM | | |
| 9% | | | |
| 10% | | | 2MPH |
| 11% | STATIC ONLY | | |
| 12% | | | |
| 13% | | | |
| 14% | | | |
| 15% | | | |

PATH OF TRAVEL SLOPE BASED CONTROL OF ASPHALT COMPACTORS

TECHNICAL FIELD

The present application relates generally to operating control of asphalt compactors. More particularly, the present application relates to asphalt compactors and controlling such machines' operation when traveling on a path upslope and/or downslope.

BACKGROUND

Asphalt and soil compactors and other working machines used in construction are operated on a variety of terrain having varying levels of slope. Such machines typically have onboard systems concerned with machine stability when operating on a side slope. As an example, a working machine can tip over on a side slope if steered at too narrow of a radius. This can be due to a center of gravity shift associated with articulated type machines, or lateral forces associated with all types of working machines while turning.

Various patents and patent applications such as U.S. Pat. Nos. 6,741,949 and 11,207,995 and Chinese Patent Application Publ. No. CN103074844A1 disclose controller systems for working machines that sense slope. However, these systems use the slope to limit tipping when operating on side sloped terrain or use the slope for other operational purposes (e.g., to calculate machine power consumption or to determine an elevation profile of the worksite). Maintaining machine stability, using slope to determine an elevation profile of a worksite or to calculate power consumption is not the focus of the present application.

SUMMARY OF THE INVENTION

In one example, a system for control of movement of an asphalt compactor within a compacting area is disclosed. Thee system optionally including: a vibratory system configured to compact an asphalt surface using force applied through one or both of a trailing drum and a leading drum; a drive system configured to propel the asphalt compactor along a direction of travel; one or more sensors configured to generate data indicative of operational criteria of the asphalt compactor, the one or more sensors including a grade sensor configured to determine a slope of the asphalt surface within the compacting area in at least the direction of travel of the asphalt compactor; and a control system communicatively coupled to the one or more sensors. The control system optionally configured to: receive data indicative of the slope of the asphalt surface in at least the direction of travel of the asphalt compactor from the grade sensor, determine if the slope of the asphalt surface is one of an incline slope or a decline slope in the direction of travel, if the slope is determined to be the incline slope, determine if the incline slope exceeds a first threshold for the incline slope, and if the incline slope exceeds the first threshold for the incline slope, control the vibratory system to stop vibration of the trailing drum.

In another example, an asphalt compactor optionally including: a vibratory system configured to compact an asphalt surface using force applied through one or both of a trailing drum and a leading drum; a brake system; a drive system configured to propel the asphalt compactor along a direction of travel; one or more sensors configured to generate data indicative of operational criteria of the asphalt compactor, the one or more sensors including a speed sensor configured to measure a speed of the asphalt compactor over an asphalt surface within a compacting area and a grade sensor configured to determine a slope of the asphalt surface within the compacting area in at least the direction of travel of the asphalt compactor; and a controller coupled to the asphalt compactor and communicatively coupled to the one or more sensors. The controller optionally configured to: receive data indicative of the speed of the asphalt compactor from the speed sensor, receive data indicative of the slope of the asphalt surface in at least the direction of travel of the asphalt compactor from the grade sensor, determine if the slope of the asphalt surface is one of an incline slope or a decline slope in the direction of travel, determine if the speed of the asphalt compactor is within a desired range of the speed for the one of the incline slope or the decline slope, if the speed exceeds the desired range of the speed for the one of the incline slope or the decline slope, determine a maximum deceleration rate for the asphalt compactor appropriate for the one of the incline slope or the decline slope, and actuate the brake system to decelerate the asphalt compactor at a rate at or below the maximum deceleration rate for the one of the incline slope or the decline slope to achieve the desired range of the speed.

In yet another example, a method for control of movement of an asphalt compactor within a compacting area is disclosed. The method optionally including: sensing one or more operational criteria of the asphalt compactor including a speed of the asphalt compactor in a direction of travel and a slope of an asphalt surface within the compacting area in at least the direction of travel of the asphalt compactor, determining if the slope of the asphalt surface is one of an incline slope or a decline slope in the direction of travel; determining if the speed of the asphalt compactor exceeds a desired range of speed for the one of the incline slope or the decline slope; reducing the speed if the speed of the asphalt compactor exceeds the desired range of speed for the one of the incline slope or the decline slope; determining if the incline slope or the decline slope exceeds a first threshold for the incline slope or a first threshold for the decline slope; and stopping vibration of at least a trailing drum if the incline slope exceeds the first threshold for the incline slope or stopping vibration of both the trailing drum and a leading drum if the decline slope exceeds the first threshold for the decline slope.

DETAILED DESCRIPTION

Figure 1:
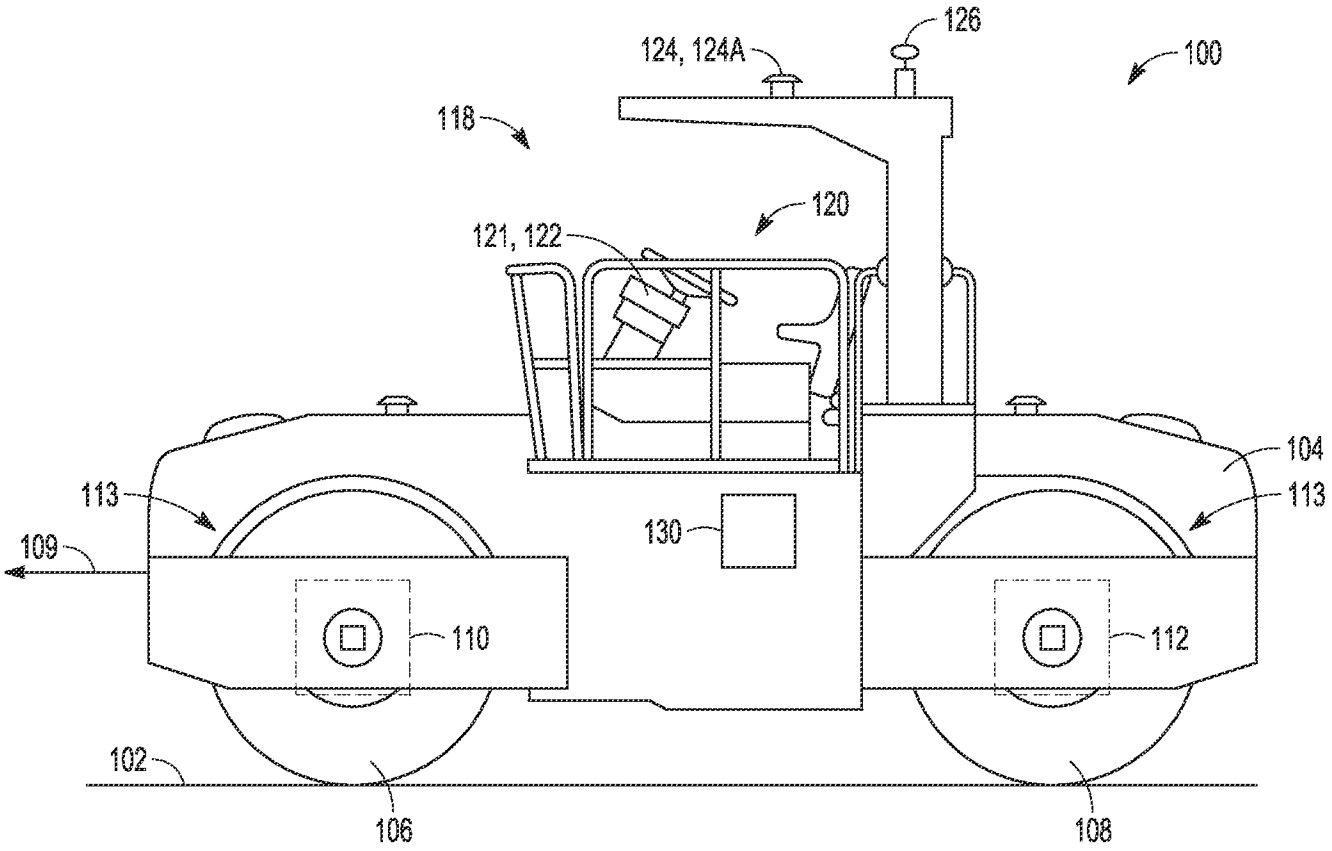
FIG. 1 is a side view of an asphalt compactor in accordance with an example of the present disclosure.

FIG. 1 shows a side view of an asphalt compactor 100, in accordance with one embodiment. The asphalt compactor 100 may be configured for use in, for example, road construction, highway construction, parking lot construction, and other asphalt paving. The asphalt compactor 100 can compress freshly deposited asphalt or other materials disposed on and/or associated with a worksite surface 102. As the asphalt compactor 100 traverses the worksite surface 102, vibrational forces generated by the asphalt compactor 100 can be imparted to the worksite surface 102. These forces, acting in cooperation with the weight of the asphalt compactor 100, compress the loose materials. The asphalt compactor 100 typically makes one or more passes over the worksite surface 102 to provide a desired level of compaction.

The asphalt compactor 100 includes a frame 104, a leading drum 106, and a trailing drum 108 with respect to a direction of travel 109 of the asphalt compactor 100. The worksite surface 102 can have variations in the vertical elevation of the worksite surface 102 over a given horizontal distance. These variations can be sensed and/or determined in real-time, near-real time or averaged for at a least a portion of the direction of travel 109 (e.g., a first pass in a first direction prior to a turn) to determine slope in the direction of travel 109 for the worksite surface 102. The slope can be an incline slope (elevation rise in the direction of travel 109), a decline slope (elevation decrease in the direction of travel 109) or little to no slope in the direction of travel 109.

The leading drum 106 and the trailing drum 108 are rotatably coupled to the frame 104 so that the leading drum 106 and the trailing drum 108 roll over the worksite surface 102 as asphalt compactor 100 travels. The leading and trailing drums 106, 108 comprise substantially cylindrical drums and/or other compaction elements of the asphalt compactor 100, and the leading and trailing drums 106, 108 can be configured to apply vibration and/or other forces to the worksite surface 102 in order to assist in compacting the worksite surface 102. Although illustrated in FIG. 1 as having leading and trailing drums 106 and 108, according to other examples the asphalt compactor 100 can have only a single drum or three or more drums. Although the leading and trailing drums 106 and 108 are each shown with a substantially smooth circumference or outer surface, in other examples, the leading drum 106 and/or the trailing drum 108 may be tapered or otherwise shaped.

The leading drum 106 can have the same or different construction as the trailing drum 108. In some examples, the leading drum 106 and/or the trailing drum 108 is an elongated, hollow cylinder with a cylindrical drum shell that encloses an interior volume. The leading drum 106 defines a first central axis about which the leading drum 106 rotates, and similarly, the trailing drum 108 defines a second central axis about which the trailing drum 108 rotates.

The leading drum 106 can include a first vibratory mechanism 110 within the cylindrical drum shell, and the trailing drum 108 can include a second vibratory mechanism 112 within the cylindrical drum shell. While the leading drum 106 is illustrated as having the first vibratory mechanism 110 and the trailing drum 108 is illustrated as having the second vibratory mechanism 112, in other examples only one of the leading and trailing drums 106, 108 may include a vibratory mechanism. The first and second vibratory mechanisms 110, 112 are part of a vibratory system 113 and can include one or more weights or masses disposed at a position off-center from the respective central axis around which each of the leading and trailing drums 106, 108 rotate. As the leading and trailing drums 106, 108 rotate, the off-center or eccentric positions of the masses induce oscillatory or vibrational forces to the leading and trailing drums 106, 108, and such forces are imparted to the worksite surface 102. The weights are eccentrically positioned with respect to the respective central axis around which each of leading and trailing drums 106, 108 rotate, and such weights are typically movable with respect to each other (e.g., about the respective central axis) to produce varying degrees of imbalance during rotation of leading and trailing drums 106, 108. The amplitude of the vibrations produced by such an arrangement of eccentric rotating weights may be varied as desired. This can be accomplished, for example, by adjusting the positions of the eccentric weights with respect to each other, thereby varying the average distribution of mass (i.e., the centroid) with respect to the axis of rotation of each of the weights. The present disclosure is not limited to the examples described above. As an example, the amplitude can be controlled between two settings; a high amplitude vibration setting and a low or lower amplitude vibration setting. The lower amplitude setting has about half of the amplitude of the high amplitude vibration setting.

The asphalt compactor 100 is contemplated to be any asphalt type compactor known in the art and is not limited to the double drum design illustrated. Asphalt compactor 100 can be operator controlled, autonomous or semi-autonomous. The asphalt compactor 100 can be equipped with various sensors making autonomous or semi-autonomous operation feasible including those that can sense obstacle(s) adjacent the asphalt compactor 100. The one or more sensors can include a speed sensor, a grade sensor, and one or more compaction sensors as known in the art to determine type of material, material density, material stiffness, temperature and/or other characteristics of worksite surface 102. One or more sensors can also measure a vibration amplitude, a vibration frequency, a speed of the eccentric weights associated with leading drum 106 and/or the trailing drum 108, a distance of such eccentric weights from the axis of rotation, a speed of rotation of the leading drum 106 and/or the trailing drum 108, etc.

The asphalt compactor 100 includes an operator station 118. However, the operator station 118 is not contemplated if the asphalt compactor 100 is fully autonomous. The operator station 118 includes a drive system 120 including a steering wheel, levers, pedals, and/or other controls (not shown) for steering and facilitating movement of the asphalt compactor 100 along the desired path of travel. The operator station 118 can have components and/or systems that are not specifically shown such as a throttle, brake system, etc. for operation of the asphalt compactor 100. Using the operator station 118, an operator of asphalt compactor 100 can adjust a speed, travel direction, and/or other aspects of asphalt compactor 100 during use. A speed sensor 121 can be utilized to determine the speed of travel of the compactor in the travel direction.

The operator station 118 also include a control interface 122 for controlling various functions of asphalt compactor 100. However, in some examples it is contemplated that control interface 122 can be remote and offboard of the asphalt compactor 100. The control interface 122 comprises one or more analog, digital, and/or touchscreen displays. The control interface 122 can be configured to display, for example, a travel path, a slope in the direction of travel, a work plan and/or speed of the asphalt compactor 100. The control interface 122 can support other functions, including displaying various operating data and communicating with various systems onboard and offboard the asphalt compactor 100.

The asphalt compactor 100 further includes one or more grade sensors 124. These can be located in any position on the asphalt compactor 100 such as on the frame 104. However, the one or more grade sensors 124 can also be remote from the asphalt compactor 100 such as within the worksite or adjacent (e.g., to a side or above the worksite), for example. The one or more grade sensors 124 can gather data regarding slope. Such data can be from sensing slope, elevation change or from other sensed data. Slope may be gathered in angular, percentage, elevation or other terms. As an example, the one or more grade sensors 124 can be an accelerometer(s), inclinometer(s), tilt sensor(s), a laser plane system, or some other suitable sensor device for determining slope.

The grade sensors 124 (and indeed the speed sensor 121) can be aspects of, can be derived from or can comprise one or more position sensors 124A that can determine a location of asphalt compactor 100. The one or more position sensors 124A can comprise a component of a global positioning system (GPS) or mobile communication system (e.g., wireless or cellular system). In one example, the one or more position sensors 124A comprise a GPS receiver, a GPS transmitter, a GPS transceiver or other such device, and the one or more position sensors 124A can be in communication with one or more GPS satellites (not shown) to determine a location of the asphalt compactor 100. Such determination of the location and/or recording of the location of the asphalt compactor 100 can done autonomously or can be initiated by the operator using the control interface 122 as further described herein. The GPS system may be used to determine the position of the asphalt compactor 100 in geographic coordinates. Alternatively, a dead reckoning system may be used to determine the position of the asphalt compactor 100 as a function of a distance traveled in one or more directions along the worksite surface 102. Other types of position determining systems may be used as well, such as, for example, laser based systems, camera based systems, mobile communication systems and combinations of systems such as GPS and inclinometer.

The asphalt compactor 100 may also include a communication device 126 configured to enable the asphalt compactor 100 to communicate with the one or more other machines, and/or with one or more remote servers, processors, or control systems located remote from the worksite at which the asphalt compactor 100 is being used. The communication device 126 can also be configured to enable the asphalt compactor 100 to communicate with one or more electronic devices located at the worksite. In some examples, the communication device 126 includes a receiver configured to receive various electronic signals including slope data, speed data, position data, navigation commands, real-time information, and/or project-specific information. In some examples, the communication device 126 is also configured to receive signals including information indicative of compaction requirements specific to worksite surface 102 based upon at least the slope in the travel direction and/or speed of the asphalt compactor 100. Additionally, the compaction requirements may include, for example, a number of passes associated with the worksite surface 102 required in order to complete the compaction of worksite surface 102, a desired stiffness, density, temperature and/or compaction of worksite surface 102, and/or other information or requirements. The communication device 126 may further include a transmitter configured to transmit position data indicative of a relative or geographic position of the asphalt compactor 100, as well as electronic data such as data acquired via one or more sensors of the asphalt compactor 100.

The asphalt compactor 100 also includes a controller 130 in electronic communication with various components including the vibratory system 113, drive system 120, control interface 122, one or more grade sensors 124, speed sensor 121, one or more position sensors 124A, communication device 126 and/or other components of asphalt compactor 100. The controller 130 receives one or more signals from the one or more grade sensors 124 including data indicating a slope of the worksite surface 102 in a direction of travel of the asphalt compactor 100. In some examples, the controller 130 using the data from one or more grade sensors 124 may be configured to determine the slope (e.g., an incline slope, flat or decline slope) as asphalt compactor 100 traverses the worksite in one or more directions. The worksite can include a roadway with the asphalt compactor 100 making an extended travel in one direction. Data may be gathered and slope determined substantially continuously or at distinct intervals during movement of asphalt compactor 100 such as at initiation of the operator using the control interface 122 or autonomously. Distinct time intervals for data capture can include milliseconds, hundredths of seconds, tenths of seconds, one second, two seconds, five seconds, ten seconds, etc.) as asphalt compactor 100 travels along the desired path. Further, any such information can be stored in a memory associated with controller 130 as discussed below.

The controller 130 can be part of a broader control system that can include additional components including some of those already discussed. The controller 130 can include, for example, software, hardware, and combinations of hardware and software configured to execute several functions related to, among others, obstacle detection for the asphalt compactor 100. The controller 130 can be an analog, digital, or combination analog and digital controller including a number of components. As examples, the controller 130 can include integrated circuit boards or ICB(s), printed circuit boards PCB(s), processor(s), data storage devices, switches, relays, or any other components. Examples of processors can include any one or more of a microprocessor, a controller, a digital signal processor (DSP), an application specific integrated circuit (ASIC), a field-programmable gate array (FPGA), or equivalent discrete or integrated logic circuitry. Commercially available microprocessors can be configured to perform the functions of the controller 130. Various known circuits may be associated with controller 130, including power supply circuitry, signal-conditioning circuitry, actuator driver circuitry (i.e., circuitry powering solenoids, motors, or piezo actuators), and communication circuitry. In some examples, the controller 130 may be positioned on the asphalt compactor 100, while in other examples the controller 130 may be positioned at an off-board location (remote location) relative to the asphalt compactor 100.

Figures 2, 3:
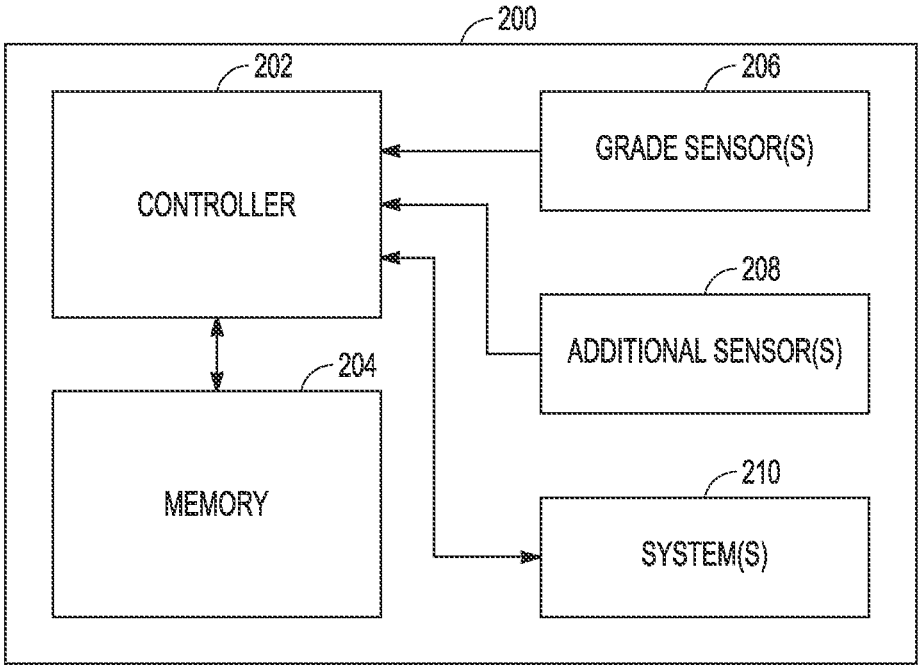
FIG. 2 is a block diagram illustrating an example control system for the asphalt compactor.
FIG. 3 is an exemplary diagram of example control methodology for the asphalt compactor when traversing an incline slope and/or a decline slope of a worksite surface.

FIG. 2 is a block diagram illustrating an example control system 200 for the asphalt compactor 100. The control system 200 includes a controller 202, memory 204, grade sensor(s) 206, sensor(s) 208, and systems 210. Control system 200 can include any additional hardware and/or software based on the needs of the specific working machine. For example, control system 200 may include, among other things, implement actuators configured to control movement of implements included on the working machine.

While illustrated as a single generic controller 202, control system 200 may include any number of separate electronic control units. For example, control system 200 may include an engine control unit, an implement control unit, a transmission control unit, a brake control unit, a control unit for a steering system, and a control unit for vibration system, for example. The actual implementation of the control units depends on the configuration of asphalt compactor 100. Each of the control units (represented together as generic controller 202), can include software, hardware, and combinations of hardware and software configured to execute functions attributed to asphalt compactor 100. Controller 202 can include integrated circuit boards or ICB(s), printed circuit boards PCB(s), processor(s), data storage devices, switches, relays, or any other circuitry. Examples of processors can include any one or more of a microprocessor, a digital signal processor (DSP), an application specific integrated circuit (ASIC), a field-programmable gate array (FPGA), or equivalent discrete or integrated logic circuitry.

Memory 204 can be any volatile memory, non-volatile memory, or combination thereof. Memory 204 may be encoded with instructions that when executed by controller 202 cause controller 202 to control operations of the asphalt compactor 100 as discussed herein and provide other control of the asphalt compactor 100. The memory 204 may include storage media to store and/or retrieve data or other information such as, for example, input data from the speed sensor 121, the vibratory system 113, the one or more slope sensors 124, one or more position sensors 124A, the communication device 126, etc. of FIG. 1. Memory 204 may also store attributes of asphalt compactor 100. For example, the attributes may include a stationary center of gravity location, weight, and other attributes of asphalt compactor 100. While illustrated as a single memory 204, control system 200 can include any number of memories. For example, each control unit may include one or more dedicated volatile and/or non-volatile memories. Examples of non-volatile storage devices include magnetic hard discs, optical discs, floppy discs, flash memories, or forms of electrically programmable memories (EPROM) or electrically erasable and programmable (EEPROM) memories. Examples of volatile storage devices include random access memories (RAM), dynamic random access memories (DRAM), static random access memories (SRAM), and other forms of volatile storage devices.

Grade sensor(s) 206 measure the slope as a percentage, angle (e.g., relative to ground/horizontal), elevation or in another manner at which asphalt compactor 100 is disposed. Grade sensor(s) 206 can include one or more different types of sensors as discussed previously for determining incline, decline, change in elevation, position, and/or orientation of asphalt compactor 100 at least in the direction of travel. Grade sensor(s) 206 can be part of or can be derived from a positioning system as previously discussed. Position data can include an external input regarding the slope of asphalt compactor 100 at the current position of the machine, or an input from another source.

Sensor(s) 208 are any other sensors located on asphalt compactor 100 or adjacent the asphalt compactor 100. The sensors 208 can be configured to gather operational data like speed, etc. and/or can sense values indicative of any environment in which asphalt compactor 100 is operating. Sensor(s) 208 may include, among others, load sensors, vibration sensors and speed sensors, for example. The speed sensor may be any sensor capable of sensing a speed at which asphalt compactor 100 is moving. The load sensor may be configured to sense a load of asphalt compactor 100. The load of asphalt compactor 100 can include the weight of the machine and the load or weight of an external load on the asphalt compactor 100.

Controller 202 can be configured to communicate with other components of control system 200 and asphalt compactor 100 via various wired or wireless communications technologies and components using various public and/or proprietary standards and/or protocols. Examples of transport mediums and protocols for electronic communication between components of asphalt compactor 100 include Ethernet, Transmission Control Protocol/Internet Protocol (TCP/IP), 802.11 or Bluetooth, or other standard or proprietary transport mediums and communication protocols.

Systems 210 can include various mechanisms and devices not specifically shown but known in the art. The systems 210 can include a vibration system, a drive system, a brake system, a steering control system etc. Systems 210 can also be configured to receive operator input. In some examples, systems 210 can alternatively or additionally be controlled automatically by controller 202.

FIG. 3 illustrates a table 300 of an example algorithm that can be implemented by the system 200 (FIG. 2) and the asphalt compactor 100 (FIG. 1). The table 300 presents slope as a percentage increase (incline) or decrease (decline). As shown, the system 200 (FIG. 2) is configured to treat the incline slope differently than the decline slope. In particular, data regarding slope of the worksite surface can be utilized by controller 202 to determine whether the slope in at least the direction of travel is incline slope, flat or decline slope. Controller 202 (FIG. 2) or controller 130 (FIG. 1) can use the determined slope, and optionally other sensed properties of the asphalt compactor 100 or environment to control operation of the compactor. These other properties of the asphalt compactor 100 can include: speed, center of gravity location, weight, size, asphalt material properties, cross-slope and/or steering turn radius, to provide for the operation control. Threshold slope values and speed values in the table 300 can be dynamic such that controller 202 (FIG. 2) or controller 130 (FIG. 1) continuously updates the threshold values based on present conditions in the environment, for example. These threshold values can also value based upon specific compactor characteristics such as center of gravity location, weight, size, steering turn radius, etc.

In one example embodiment, table 300 illustrates that the controller can implement a plurality of threshold slope values for the incline slope in the direction of travel. If the slope is determined to be the incline slope, the controller can determine if the incline slope exceeds a first threshold for the incline slope. If the incline slope exceeds the first threshold for the incline slope, the controller, according to table 300, can control the vibratory system to stop vibration of the trailing drum (the trailing drum 108 of FIG. 1).

As shown in the table 300 of FIG. 3, if the incline slope exceeds a second threshold for the incline slope, the control system controls the vibratory system to reduce an amplitude of vibration of the leading drum such as to the lower amplitude setting discussed previously. If the incline slope exceeds a third threshold for the incline slope, the control system controls the vibratory system to stop vibration of both the trailing drum and the leading drum. As shown in FIG. 3, the first threshold for the incline slope is greater than about 5% incline slope but less than about 8% incline slope, the second threshold for the incline slope is greater than about 8% incline slope but less than about 11% incline slope, and the third threshold for the incline slope is greater than about 11% incline slope. As used herein the term "about" or "substantially" means within 10% of the value provided. Thus, as an example, the 11% discussed above can vary by +1.1% from the 11% discussed.

FIG. 3 also illustrates that if the slope is determined to be the decline slope, the controller can determine if the decline slope exceeds a first threshold for the decline slope. If the decline slope exceeds the first threshold for the decline slope, the controller can control the vibratory system to at least stop vibration of both the trailing drum and the leading drum. The first threshold for the decline slope can comprise a single threshold for the decline slope, and the single threshold for the decline slope can be at or greater than about 4% decline slope.

Speed of the compactor can also be a variable in the algorithm of FIG. 3. Thus, the table 300 provides three thresholds and four ranges of speeds for the compactor. Below about a 3% slope (either incline slope or decline slope) the speed of the compactor is not restricted. Between about 4% slope and 6% slope (either incline slope or decline slope) the first maximum speed threshold for the asphalt compactor can be about 4 miles per hour. The compactor can also operate in a speed range below 4 miles per hour. Between about 7% and 9% slope (either incline slope or decline slope) the second maximum speed threshold for the asphalt compactor can be about 3 miles per hour. Again, the compactor can also operate in a speed range below 3 miles per hour. Between about 10% and 15% slope (either incline slope or decline slope) the third maximum speed threshold for the asphalt compactor can be about 2 miles per hour. The compactor can also operate in a speed range below 2 miles per hour. Operation of the asphalt compactor above about 15% slope (incline slope or decline slope) is not advised.

Figure 4:
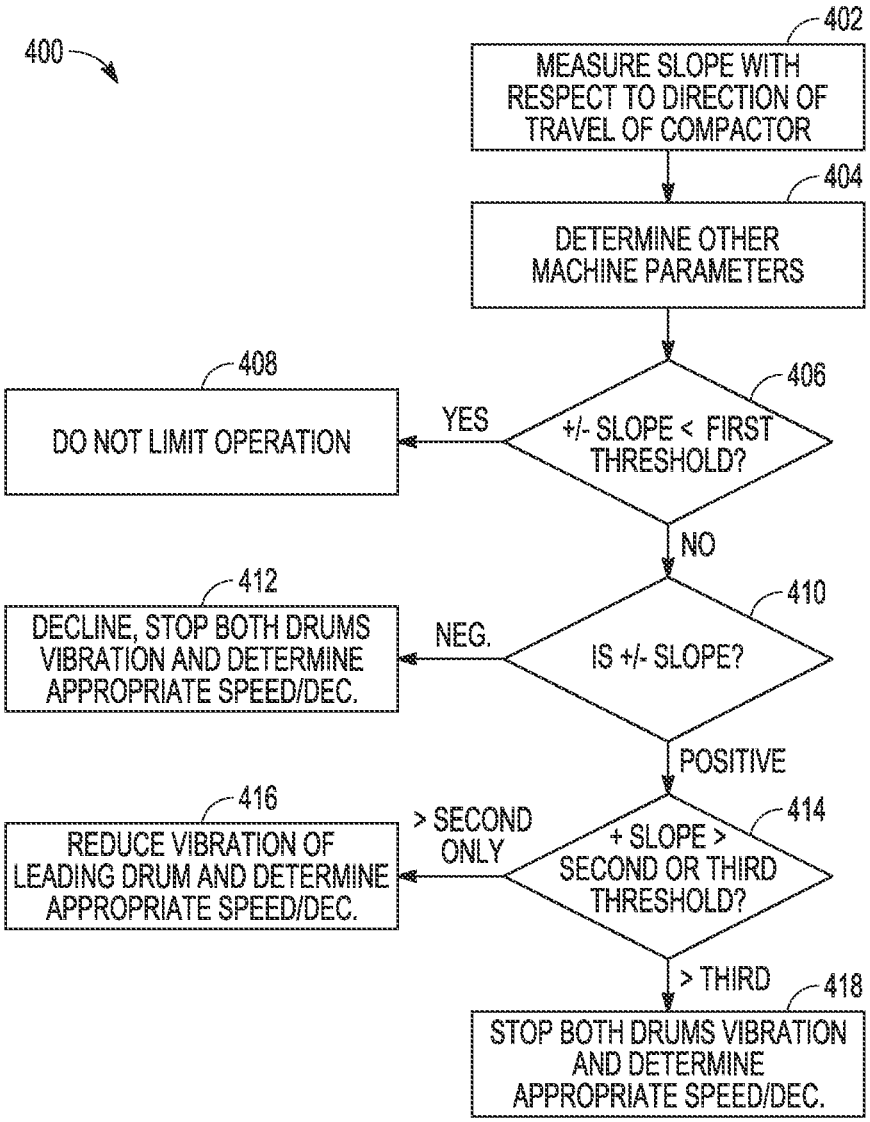
FIG. 4 is a flowchart illustrating a method of controlling operation of the asphalt compactor based on one or more criteria.

FIG. 4 is a flowchart illustrating method 400 of controlling operation of an asphalt controller. At step 402, a control system of the asphalt compactor determines a slope of the worksite surface. At step 404, other machine parameters are considered by the control system including, but not limited to, speed, center of gravity location, weight, size, asphalt material properties, cross-slope and/or steering turn radius of the asphalt compactor. The machine and environment parameters may be used to set slope thresholds for the asphalt compactor as previously discussed in connection with FIG. 3.

The measured slope is compared to a first threshold slope, which can be different for the decline slope as compared to the incline slope at step 406. If the determined slope is less than the first threshold slope, the method 400 proceeds to step 408 and does not limit operation (e.g., vibration of the drum(s) of the compactor, speed, etc.). The operator, if controlling the compactor can operate at an amplitude, frequency, speed, etc. as desired. If the determined slope is greater than or equal to the first threshold slope, the method 400 proceeds to step 410. At step 410 it is determined if the slope is a decline slope (−) or an incline slope (+) as different operational control applies to each circumstance. If the slope is a decline slope, the method at step 412 stops vibration of both drums and determines an appropriate operational speed (see e.g., FIG. 3 and discussion) based upon the measured decline slope. The method at 412 can also control deceleration of the compactor to the desired speed to be at a deceleration rate that is reduced from a maximum deceleration rate for a flat surface.

As an example, the method 400 can include determining if the speed of the asphalt compactor is within a desired range of the speed for the decline slope. If the speed exceeds the desired range of the speed for the decline slope (see e.g., table 300 of FIG. 3 for speed ranges and applicable slope values), the method 400 can determine a maximum deceleration rate for the asphalt compactor appropriate for the decline slope. The controller can actuate the brake system to decelerate the asphalt compactor at a rate at or below the maximum deceleration rate for the decline slope to achieve the desired range of the speed. Controlling deceleration of the asphalt compactor prevents damage or undesirable finish to the worksite surface 102.

If the slope is an incline slope, the measured slope is compared to a second threshold for the incline slope at step 414. The step 414 can optionally compare the measured slope to a third threshold of the incline slope. This determination can also be performed as a separate step. If the measured slope is greater than only the second threshold for the incline slope (i.e., exceeds the second threshold for the incline slope but does not exceed the third threshold for the incline slope), the method 400 proceeds to step 416 and the control system reduces vibration of the leading drum to a lower amplitude and determines an appropriate operational speed (see e.g., FIG. 3 and discussion) based upon the measured incline slope. The method at 416 can also control deceleration of the compactor to the desired speed to be at a deceleration rate that is reduced from a maximum deceleration rate for a flat surface. Again, controlling deceleration prevents damage or undesirable finish to the worksite surface 102.

As an example, the method 400 can include determining if the speed of the asphalt compactor is within a desired range of the speed for the incline slope. If the speed exceeds the desired range of the speed for the incline slope (see e.g., table 300 of FIG. 3 for speed ranges and applicable slope values), the method 400 can determine a maximum deceleration rate for the asphalt compactor appropriate for the incline slope. The controller can actuate the brake system or reduce throttle to decelerate the asphalt compactor at a rate at or below the maximum deceleration rate for the incline slope to achieve the desired range of the speed.

If the measured slope is greater than the third threshold, method 400 proceeds to step 418 and the control system stops vibration of both leading and trailing drums and determines an appropriate operational speed (see e.g., FIG. 3) based upon the measured incline slope. The method at 418 can also control deceleration of the compactor to the desired speed. If the incline slope or decline slope is sensed to be above a certain percentage (e.g., above 15%), the method via controller can include stopping the compactor and/or alerting the operator that too great an incline/decline is sensed for operation.

INDUSTRIAL APPLICABILITY

As an asphalt compactor moves from various locations, the asphalt compactor may be required to traverse various slopes in the direction of travel including incline slopes and/or decline slopes. Laying a uniform asphalt mat on incline slopes and decline slopes can be challenging due to shifts in asphalt compactor's center of gravity and shifts in the orientation of the application of forces through the drums. Conventional vibration systems for asphalt compactors do not account for incline slopes and decline slopes. It is desirable to automatically control operation of the asphalt compactor when traversing incline slopes and decline slopes to prevent a non-uniform or otherwise poorly compacted asphalt mat. Improved quality of the mat on incline slopes and decline slopes can be facilitated by control of the vibration system, control of the speed of the asphalt compactor and/or control of deceleration among other aspects that can be controlled.

The asphalt compactor can therefore include a control system that is configured to automatically determine the slope of a path or direction of travel the asphalt compactor is traversing and limit the vibration amplitude, frequency, speed and/or deceleration, etc. based on the determined slope. Such control results in an improved asphalt mat quality with a reduction in instances of non-uniform or otherwise poorly compacted asphalt mat due to the slope. In one example, the control system is able to receive sensor inputs regarding the current incline or decline in the direction of travel (e.g., through on-board slope sensor, off-board input like smartphone, GPS, etc.) and suggest/alert/coach and/or automatically adjust compactor operation settings to those best appropriate for the current incline or decline. For example, vibratory settings that can be adjusted include power (on/off), amplitude, frequency, and/or oscillation for particular drums (e.g., leading drum and/or trailing drum). Compactor speed may also be varied based on sensed/input incline or decline.

In some examples, the control system may utilize thresholds based upon the degree of incline/decline to adjust or set various operation criteria. For example, when the asphalt compactor is travelling downhill at a smaller decline versus a flat surface, lower amplitude or frequency of vibration may be desired for better quality mat results. Whereas, if the compactor is travelling downhill at a steep decline, such criteria may call for turning the vibration off completely. In another example, if the compactor is travelling uphill at a certain degree of incline, the asphalt compactor may best perform compaction with a leading vibratory mechanism in the leading drum powered on, but with a trailing vibratory mechanism in the trailing drum turned off. In some examples, the compactor based upon the degree of the decline or incline slope may lock out an operator from using vibration on the downhill/uphill to avoid a wash boarding or other undesirable effect.

Automatic control of asphalt compactor operations including speed, vibration, etc. based on determined incline slope and decline slope provides significant advantages. Asphalt compactors operate on varying terrain. By automatically controlling operations of the compactor based on slope, human error can be reduced, and the compactors can be operated with better quality results in terms of the uniformity of the asphalt mat being compacted.

The above detailed description is intended to be illustrative, and not restrictive. The scope of the disclosure should, therefore, be determined with references to the appended claims, along with the full scope of equivalents to which such claims are entitled.

What is claimed is:

1. A system for control of movement of an asphalt compactor within a compacting area, the system comprising:

a vibratory system configured to compact an asphalt surface using force applied through one or both of a trailing drum and a leading drum;

a drive system configured to propel the asphalt compactor along a direction of travel;

one or more sensors configured to generate data indicative of operational criteria of the asphalt compactor, the one or more sensors including a grade sensor configured to determine a slope of the asphalt surface within the compacting area in at least the direction of travel of the asphalt compactor; and a control system communicatively coupled to the one or more sensors, the control system configured to:

receive data indicative of the slope of the asphalt surface in at least the direction of travel of the asphalt compactor from the grade sensor, determine if the slope of the asphalt surface is one of an incline slope or a decline slope in the direction of travel, if the slope is determined to be the incline slope, determine if the incline slope exceeds a first threshold for the incline slope, and if the incline slope exceeds the first threshold for the incline slope, control the vibratory system to stop vibration of the trailing drum.

2. The system of claim 1, wherein if the incline slope exceeds a second threshold for the incline slope, the control system controls the vibratory system to reduce an amplitude of vibration of the leading drum.

3. The system of claim 2, wherein if the incline slope exceeds a third threshold for the incline slope, the control system controls the vibratory system to stop vibration of both the trailing drum and the leading drum.

4. The system of claim 3, wherein the first threshold for the incline slope is greater than about 5% incline slope but less than about 8% incline slope, wherein the second threshold for the incline slope is greater than about 8% incline slope but less than about 11% incline slope, and wherein the third threshold for the incline slope is greater than about 11% incline slope.

5. The system of claim 1, further comprising a brake system, wherein the one or more sensors include at least a speed sensor configured to measure a speed of the asphalt compactor over the asphalt surface within the compacting area;

wherein the control system is configured to:

receive data indicative of the speed of the asphalt compactor from the speed sensor, determine if the speed of the asphalt compactor is within a desired range of the speed for the incline slope, if the speed exceeds the desired range of the speed for the incline slope, determine a maximum deceleration rate for the asphalt compactor appropriate for the incline slope, and actuate the brake system to decelerate the asphalt compactor at a rate at or below the maximum deceleration rate for the incline slope to achieve the desired range of the speed.

6. The system of claim 1, wherein the control system is configured to:

if the slope is determined to be the decline slope, determine if the decline slope exceeds a first threshold for the decline slope, and if the decline slope exceeds the first threshold for the decline slope, control the vibratory system to at least stop vibration of both the trailing drum and the leading drum.

7. The system of claim 6, further comprising a brake system, wherein the one or more sensors include at least a speed sensor configured to measure a speed of the compactor over the asphalt surface within the compacting area;

wherein the control system is configured to:

receive data indicative of the speed of the asphalt compactor from the speed sensor, determine if the speed of the asphalt compactor is within a desired range of the speed for the decline slope, if the speed exceeds the desired range of the speed for the decline slope, determine a maximum deceleration rate for the asphalt compactor appropriate for the decline slope, and actuate the brake system to decelerate the asphalt compactor at a rate at or below the maximum deceleration rate for the decline slope to achieve the desired range of the speed.

8. The system of claim 6, wherein the first threshold for the decline slope comprises a single threshold for the decline slope, and wherein the single threshold for the decline slope is at or greater than about 4% decline slope.

9. An asphalt compactor comprising:

a vibratory system configured to compact an asphalt surface using force applied through one or both of a trailing drum and a leading drum;

a brake system;

a drive system configured to propel the asphalt compactor along a direction of travel;

one or more sensors configured to generate data indicative of operational criteria of the asphalt compactor, the one or more sensors including a speed sensor configured to measure a speed of the asphalt compactor over an asphalt surface within a compacting area and a grade sensor configured to determine a slope of the asphalt surface within the compacting area in at least the direction of travel of the asphalt compactor; and a controller coupled to the asphalt compactor and communicatively coupled to the one or more sensors, the controller configured to:

receive data indicative of the speed of the asphalt compactor from the speed sensor, receive data indicative of the slope of the asphalt surface in at least the direction of travel of the asphalt compactor from the grade sensor, determine if the slope of the asphalt surface is one of an incline slope or a decline slope in the direction of travel, determine if the speed of the asphalt compactor is within a desired range of the speed for the one of the incline slope or the decline slope, if the speed exceeds the desired range of the speed for the one of the incline slope or the decline slope, determine a maximum deceleration rate for the asphalt compactor appropriate for the one of the incline slope or the decline slope, actuate the brake system to decelerate the asphalt compactor at a rate at or below the maximum deceleration rate for the one of the incline slope or the decline slope to achieve the desired range of the speed, if the slope is determined to be the incline slope, determine if the incline slope exceeds a first threshold for the incline slope, and if the incline slope exceeds the first threshold for the incline slope, control the vibratory system to stop vibration of the trailing drum.

10. The asphalt compactor of claim 9, wherein if the incline slope exceeds a second threshold for the incline slope, the controller controls the vibratory system to reduce an amplitude of vibration of the leading drum.

11. The asphalt compactor of claim 10, wherein if the incline slope exceeds a third threshold for the incline slope, the controller controls the vibratory system to stop vibration of both the trailing drum and the leading drum.

12. The asphalt compactor of claim 11, wherein the first threshold for the incline slope is greater than about 5% incline slope but less than about 8% incline slope, wherein the second threshold for the incline slope is greater than about 8% incline slope but less than about 11% incline slope, and wherein the third threshold for the incline slope is greater than about 11% incline slope.

13. The asphalt compactor of claim 9, wherein the controller is configured to:

if the slope is determined to be the decline slope, determine if the decline slope exceeds a first threshold for the decline slope, and if the decline slope exceeds the first threshold for the decline slope, control the vibratory system to at least stop vibration of both the trailing drum and the leading drum.

14. The asphalt compactor of claim 13, wherein the first threshold for the decline slope comprises a single threshold for the decline slope, and wherein the single threshold for the decline slope is at or greater than about 4% decline slope.

15. A method for control of movement of an asphalt compactor within a compacting area, the method comprising:

sensing one or more operational criteria of the asphalt compactor including a speed of the asphalt compactor in a direction of travel and a slope of an asphalt surface within the compacting area in at least the direction of travel of the asphalt compactor;

determining if the slope of the asphalt surface is one of an incline slope or a decline slope in the direction of travel;

determining if the speed of the asphalt compactor exceeds a desired range of speed for the one of the incline slope or the decline slope;

reducing the speed if the speed of the asphalt compactor exceeds the desired range of speed for the one of the incline slope or the decline slope;

determining if the incline slope or the decline slope exceeds a first threshold for the incline slope or a first threshold for the decline slope; and stopping vibration of at least a trailing drum if the incline slope exceeds the first threshold for the incline slope or stopping vibration of both the trailing drum and a leading drum if the decline slope exceeds the first threshold for the decline slope.

16. The method of claim 15, further comprising:

determining if the incline slope exceeds one of a second threshold for the incline slope or a third threshold for the incline slope; and implementing one of:

reducing an amplitude of vibration of the leading drum if the incline slope exceeds the second threshold for the incline slope but does not exceed the third threshold for the incline slope; or stopping vibration of both the trailing drum and the leading drum if the incline slope exceeds the third threshold for the incline slope.

17. The method of claim 16, wherein the first threshold for the incline slope is greater than about 5% incline slope but less than about 8% incline slope, wherein the second threshold for the incline slope is greater than about 8% incline slope but less than about 11% incline slope, and wherein the third threshold for the incline slope is greater than about 11% incline slope.

18. The method of claim 15, wherein the first threshold for the decline slope comprises a single threshold for the decline slope, and wherein the single threshold for the decline slope is at or greater than about 4% decline slope.

19. The method of claim 15, further comprising:

determining a maximum deceleration rate for the asphalt compactor appropriate for the one of the incline slope or the decline slope, and decelerating the asphalt compactor at a rate at or below the maximum deceleration rate for the one of the incline slope or the decline slope to achieve the desired range of the speed.

* * * * *